US006264254B1

(12) United States Patent
Siegfried et al.

(10) Patent No.: US 6,264,254 B1
(45) **Date of Patent: *Jul. 24, 2001**

(54) HANDLE MECHANISM WITH CHILD SECURITY LOCK

(75) Inventors: Kenneth John Siegfried, Clarkston; Lloyd Walker Rogers, Jr., Shelby Township, Macomb County; John R. Rice, Clinton Township, Macomb County, all of MI (US)

(73) Assignee: General Motors Corporation, Detroit, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/138,243

(22) Filed: Aug. 21, 1998

(51) Int. Cl.[7] ..... E05B 3/00
(52) U.S. Cl. ..... 292/336.3; 292/216; 292/169.12
(58) Field of Search ..... 292/169.12, 202, 292/216, 336.3, DIG. 26, DIG. 2

(56) References Cited

U.S. PATENT DOCUMENTS 2,939,308 * 6/1960 Trammell ..... 70/210
4,778,207 * 10/1988 Gergoe ..... 292/336.3
4,796,934 * 1/1989 Kesel ..... 292/336.3
4,889,373 * 12/1989 Ward ..... 292/336.3
5,046,769 * 9/1991 Rimbey et al. ..... 292/216
5,123,687 * 6/1992 Pfeiffer ..... 292/336.3
5,277,461 * 1/1994 Dzurko et al. ..... 292/216
5,308,128 * 5/1994 Portelli et al. ..... 292/216
5,676,409 * 10/1997 Trammell ..... 292/336.3
5,681,068 * 10/1997 Kleefeldt et al. .
5,725,262 * 3/1998 Kritzler ..... 292/336.3
5,738,394 * 4/1998 Arabia ..... 292/216

FOREIGN PATENT DOCUMENTS

0169644 * 1/1986 (EP) .
2284 853 * 6/1995 (GB) .

* cited by examiner

*Primary Examiner*—B. Dayoan
*Assistant Examiner*—Gary Estremsky
(74) *Attorney, Agent, or Firm*—Patrick M. Griffin

(57) ABSTRACT

A handle mechanism for operating a vehicle door latch has a handle lever for operating the latching mechanism of a vehicle door latch and a button handle for operating the locking mechanism of the vehicle door latch. The handle mechanism includes a child security lock that disables the handle mechanism so that it cannot unlatch the vehicle door latch. The child security lock is engaged by the handle lever and disengaged by manipulating the handle lever and the button handle in a predetermined sequence.

9 Claims, 14 Drawing Sheets

HANDLE MECHANISM WITH CHILD SECURITY LOCK

TECHNICAL FIELD

A handle mechanism for operating a vehicle door latch has a handle lever for operating the latching mechanism of a vehicle door latch and a button handle for operating the locking mechanism of the vehicle door latch. The handle mechanism includes a child security lock that disables the handle mechanism so that it cannot unlatch the vehicle door latch. The child security lock is engaged by the handle lever and disengaged by manipulating the handle lever and the button handle in a predetermined sequence.

BACKGROUND OF THE INVENTION

Vehicle door latches typically include a latching mechanism for latching the vehicle door in the closed position and unlatching the vehicle door so that it can be pushed or pulled open. Vehicle door latches also typically include a locking mechanism that disables the latching mechanism after the door is latched in the closed position to prevent unauthorized or inadvertent unlatching and opening of the vehicle door. The latching mechanism typically includes separate links that are attached to respective inside and outside operators such as interior and exterior door handles for operating the latching mechanism. The locking mechanism typically includes separate links that are attached to respective inside and outside operators, such as an interior sill button and an exterior lock cylinder, for operating the locking mechanism. See, for instance, U.S. Pat. No. 5,277,461 granted to Thomas A. Dzurko et al Jan. 11, 1994 for a vehicle door latch of the type described above.

Vehicle door latches have included various ancillary features over the years. One of these features is a child security lock that is engaged to prevent operation of the latching mechanism by the interior door handle or other interior operator. The prior art vehicle door latches with child security locks typically include a decoupling member in the linkage system that connects the vehicle door latch to the interior door handle. The decoupling member is typically manually operated by an independent operator that is either hidden or inaccessible when the vehicle door is closed to prevent young passengers from disengaging the child security lock. However, such an inaccessible operator also prevents adult passengers from disengaging the child security lock and exiting the vehicle. See, for instance, U.S. Pat. No. 5,046,769 granted to Ronald P. Rimby and Rita M. Paulik Sep. 10, 1991 for a door latch coupling arrangement and U.S. Pat. No. 5,308,128 granted to Alfred L. Portelli and Rita M. Paulik May 3, 1994 for a vehicle door latch.

SUMMARY OF THE INVENTION

The object of this invention is to provide an operator for engaging or disengaging a child security lock that is readily accessible from the interior of the vehicle yet deters operation by young passengers.

A feature of the invention is that the operator for the child security lock of the vehicle door latch is part of an interior door handle mechanism for a vehicle door that includes a handle lever for operating the latching mechanism and a button handle for operating the locking mechanism of the vehicle door latch.

Another feature of the invention is that the handle mechanism includes a child security lock that is engaged easily but that requires two-handed operation for disengagement.

Another feature of the invention is that the handle mechanism includes a child security lock that is engaged easily but that requires a sequence of operations for disengagement so as to deter operation by young children.

Still another feature of the invention is that the handle mechanism includes a child security lock that is engaged and disengaged mechanically and thus operates independently of the vehicle electric power supply.

Yet another feature of the invention is that the handle mechanism has a child security lock that can be engaged or disengaged while the vehicle door is open or closed.

Still yet another feature of the invention is that the handle mechanism includes a handle lever that pivots in one direction to operate a door latch and an opposite direction to operate a child security lock and a unique spring arrangement for biasing the handle lever to a neutral or latch position between the two.

These and other objects, features and advantages of the invention will become more apparent from the following description of a preferred embodiment taken in conjunction with the accompanying drawings.

DESCRIPTION OF THE PREFERRED EMBODIMENT

Figure 1:
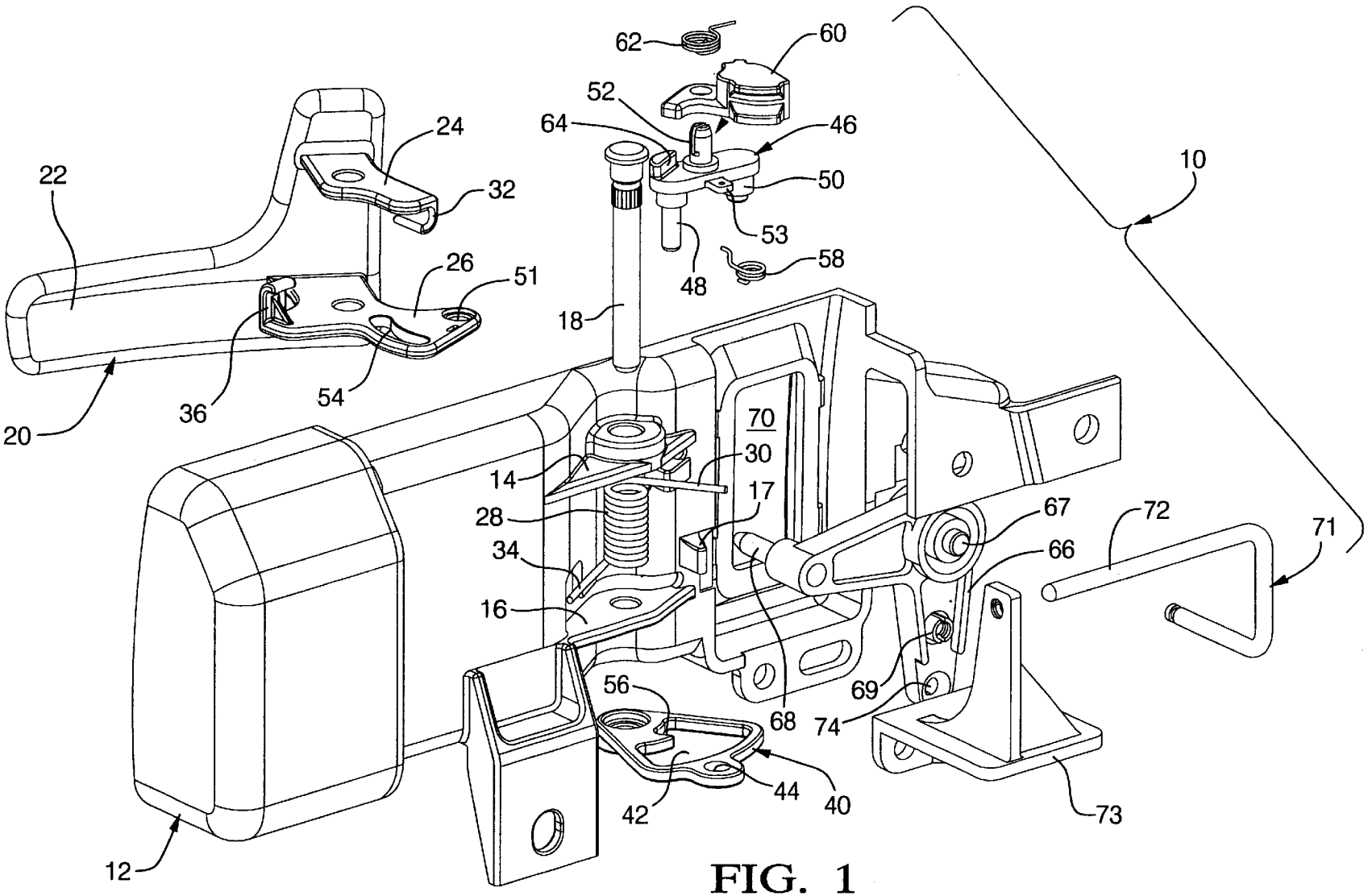
FIG. 1 is an exploded perspective rear view of a handle mechanism in accordance with the invention.

Referring now to the drawing, FIG. 1 shows a handle mechanism of the invention indicated generally at 10. Handle mechanism 10 comprises a housing 12 having a pair of integral, vertically spaced pivot gussets 14 and 16 and a cam projection 17 on the back side, a pivot pin 18 that extends through aligned holes in the pivot gussets and a handle lever 20 that is pivotally mounted on housing 12 by pivot pin 18. Handle lever 20 has a generally flat body or handle 22 with upper and lower arms 24 and 26 protruding from the rear face of the body 22 at one end in perpendicular fashion. Handle 22 lies adjacent the front of housing 12 with upper and lower arms 24 and 26 protruding through respective slots of housing 12 to the back side where journal portions of arms 24 and 26 surround pivot pin 18.

A coil spring 28 is disposed between the upper and lower arms 24 and 26 and surrounds pivot pin 18 loosely. Coil spring 28 has two tangential ends. End 30 engages abutment 32 of upper arm 24 and opposite end 34 engages abutment 36 of lower arm 26. Spring ends 30 and 34 also engage housing 12 so that coil spring 28 holds handle lever 20 in a neutral position and returns handle lever 20 to the neutral position when handle lever 20 is pivoted clockwise or counterclockwise as explained below. Handle lever 20 is pivoted from the neutral position shown in FIG. 1 in a clockwise direction for an unlatching operation or in a counterclockwise direction to engage a child security lock which is also explained in detail below.

Handle mechanism 10 further comprises an unlatching lever 40 that pivots on the lower end of pivot pin 18 below the lower pivot gusset 16. Unlatching lever 40 has an L-shaped slot 42 and an attachment hole 44 for attaching lever 40 to a door latch (not shown) by a control rod or other suitable linkage (not shown). Unlatching lever 40 is pivoted from the neutral position shown in FIG. 1 clockwise to an unlatching position via slot 42 to unlatch a conventional door latch in a well known manner as explained below.

Handle mechanism 10 further comprises a child security lever 46 that has a depending drive pin 48 at one end, a depending pivot pin 50 at the opposite end and an upwardly projecting pivot pin 52 midway between its ends. Drive pin 48 extends through a generally radial slot 54 in the lower arm 26 of handle lever 20 and projects into slot 42 of unlatching lever 40. Pivot pin 50 pivots in a pivot hole 51 of lower arm 26. Child security lever 46 is thus pivotally mounted on lower arm 26 for movement between a decoupled position and a drive position determined by the opposite ends of slot 54. When child security lever 46 is in the drive position, drive pin 48 engages an inner end of radial slot 54 and a drive shoulder 56 in the narrow inner end of slot 42. When child security lever 46 is in the decoupled or lost motion position, drive pin 48 engages an outer end of radial slot 54 and is located in the wide outer end of slot 42 where drive pin 48 bypasses drive shoulder 56 and moves in slot 42 without driving unlatching lever 40.

Handle mechanism 10 includes an over center coil spring 58 that has one end attached to tab 53 of child security lever 46 and the other end attached to lower arm 26 and operates in a well-known manner so that drive pin 48 is biased against one or the other ends of the slot 54 of arm 26.

A bypass lever 60 pivots on pivot pin 52 of child security lever 46. A coil return spring 62 is on top of bypass lever 60 around pivot pin 52. One end of spring 62 engages bypass lever 60 and the opposite end of spring 62 fits in a slot of pivot pin 52 so that bypass lever 60 is spring biased clockwise as viewed in FIG. 1 against an elevated stop 64 of child security lever 46.

Handle mechanism 10 includes a locking lever 66 that pivots on a horizontal pivot 67 projecting from the backside of housing 12. Locking lever 66 is shaped like a bell crank lever and has a button handle 68 at an end of one leg that projects through a window 70 of the housing 12 so that the locking lever 66 is operated from the front of housing 12. Locking lever 66 has a flanged hole 69 midway in the other leg for attaching lever 66 to a door latch (not shown) by a control rod or other suitable linkage (not shown). Unlocking lever 66 is pivoted from the locked position shown in FIG. 1 clockwise to an unlocked position using button handle 68 to unlock the door latch (not shown) as explained below.

Locking lever 66 also controls a push rod 71 that has an end portion 72 that slides in a bracket 73 that is attached to the back side of housing 12. The opposite end of push rod 71 is secured in an attachment hole 74 of locking lever 66 so that the end portion 72 of push rod 71 translates longitudinally in a generally horizontal direction when locking lever 66 is pivoted on horizontal pivot 67 that is generally perpendicular to the end portion 72. End portion 72 thus translates between a locked position corresponding to the locked position of locking lever 66 and an unlocked position corresponding to the unlocked position of locking lever 66. End portion 72 engages and pivots bypass lever 60 under certain conditions as explained below.

The Normal Unlatching Operation

Figure 2:
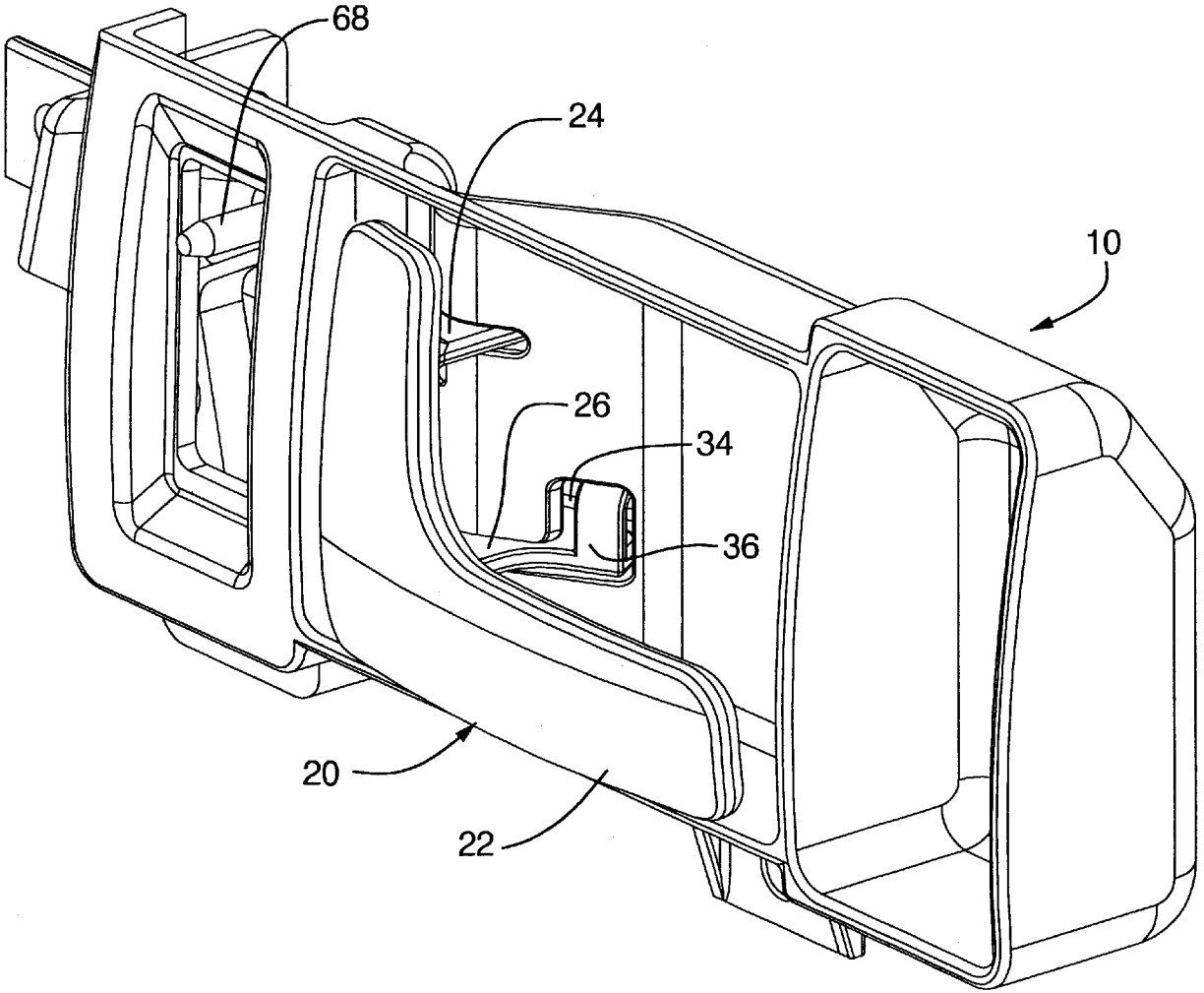
FIG. 2 is a front perspective view of the handle mechanism and FIG. 3 is a rear perspective view of the handle mechanism showing the parts in their respective positions when the handle mechanism is in a latched and unlocked condition with the child security lock disengaged.
Figure 3:
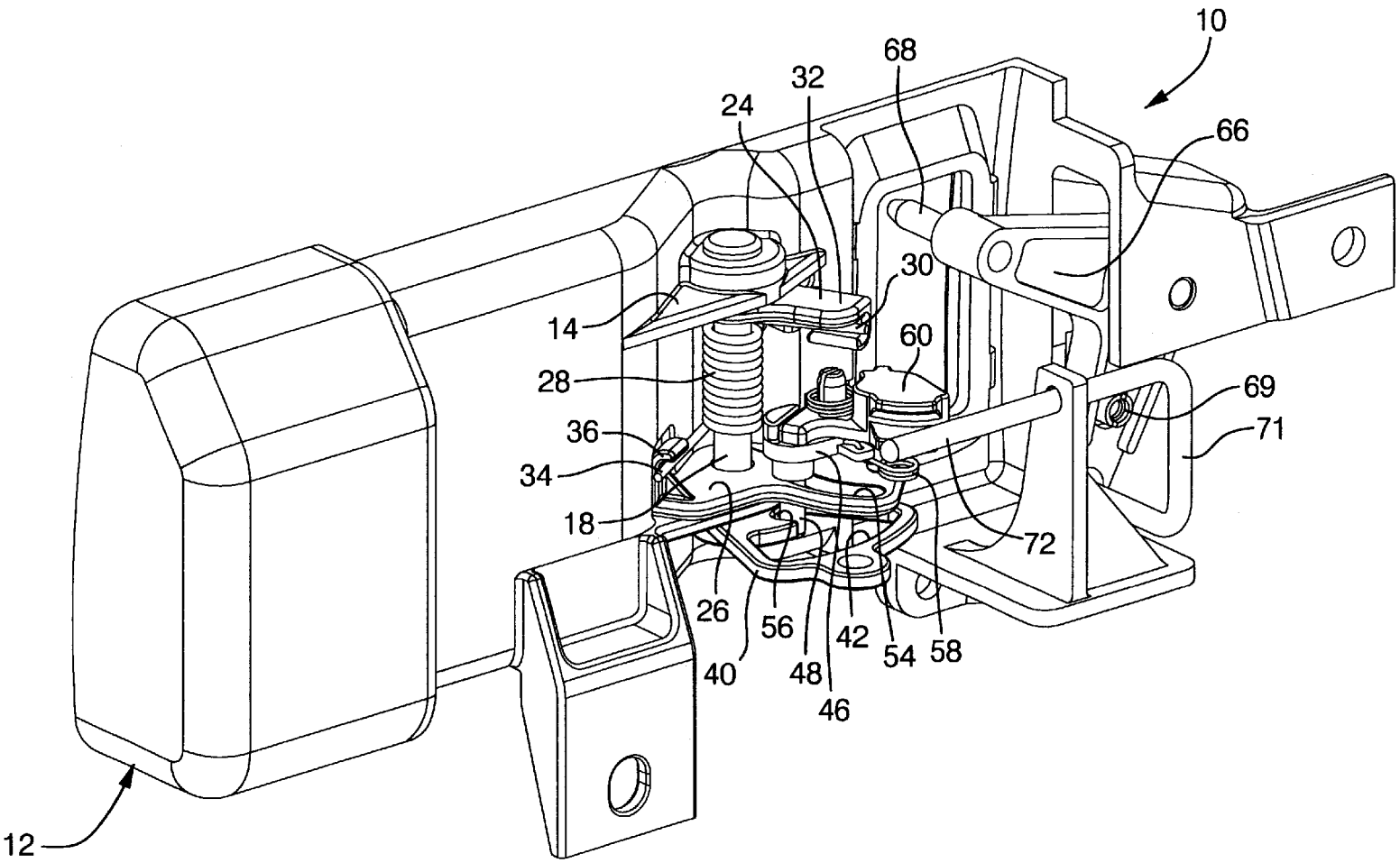
Figure 4:
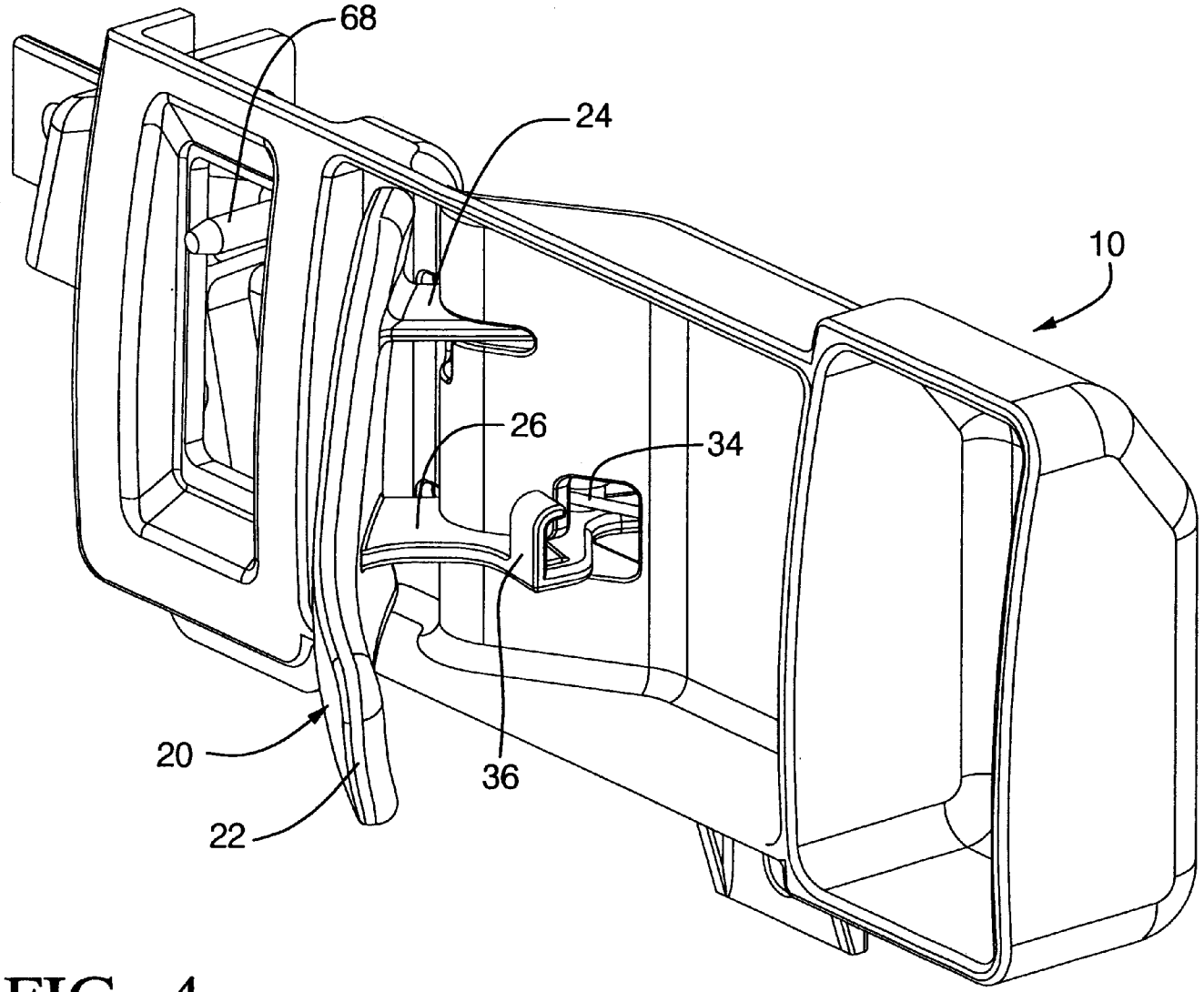
FIG. 4 is a front perspective view showing the pats in their respective positions when the handle mechanism is in a latched and unlocked condition with the child security lock disengaged.
Figure 5:
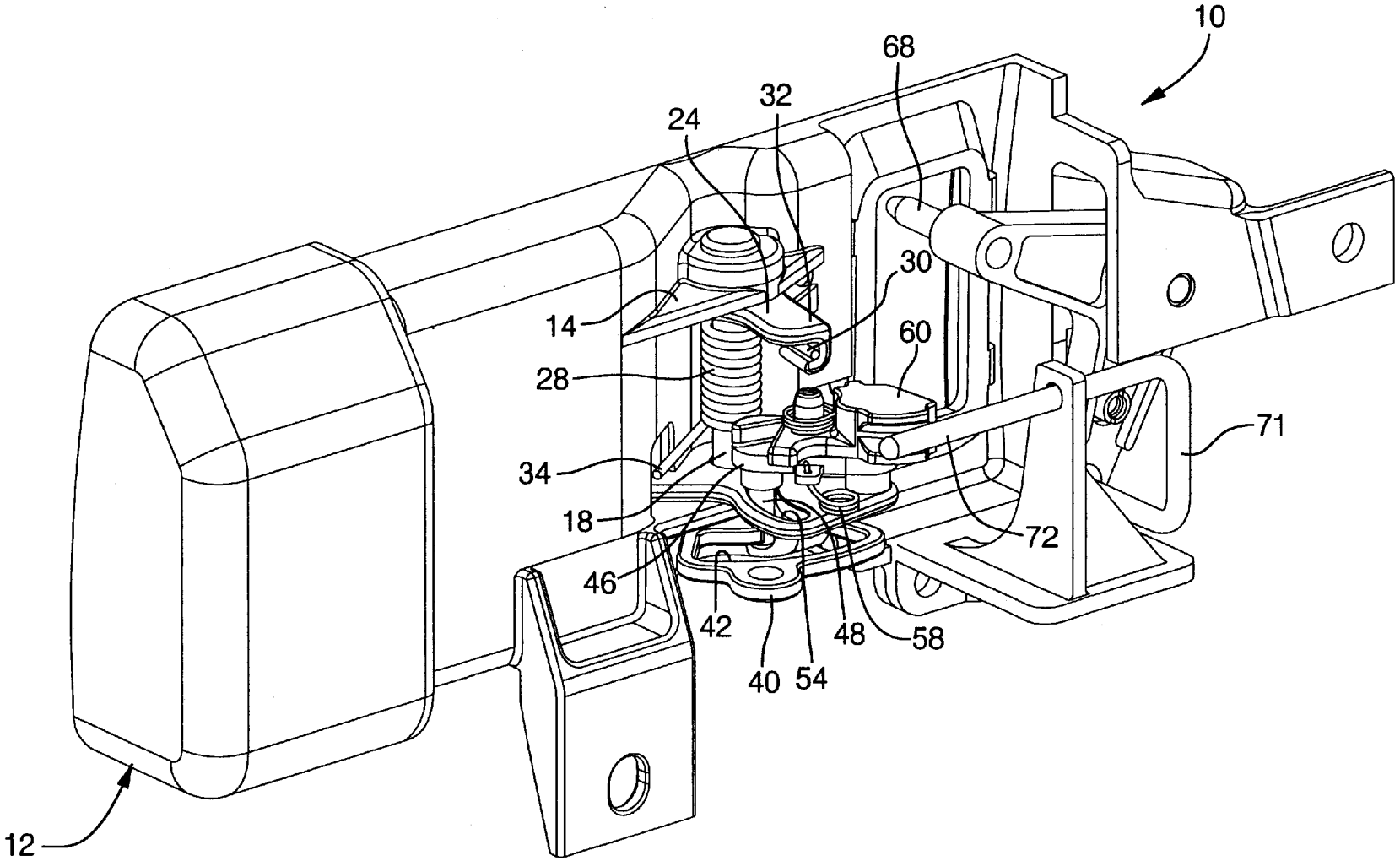
FIG. 5 is a rear perspective view showing the handle mechanism with the parts in an unlatched position when the handle mechanism is unlocked and the child security lock is disengaged.

Referring now to FIGS. 2, 3, 4 and 5, the normal unlatching operation of handle mechanism 10 is as follows. FIG. 2 is a front perspective view of the handle mechanism 10 and FIG. 3 is a rear perspective view showing the handle mechanism 10 with the parts in a latched and unlocked condition with the child security lock disengaged. FIGS. 4 and 5 show the handle mechanism 10 with the parts in an unlatched and unlocked condition with the child security lock disengaged.

Handle mechanism 10 unlatches a conventional door latch (not shown) in well-known manner simply by pulling the end of handle 22 outwardly, which pivots the handle 22 of handle lever 20 outwardly from the flush neutral position (latched position) shown in FIG. 2 in a clockwise direction to the extended angular position (unlatched position) shown in FIG. 4. This pivots upper and lower arms 24 and 26 of handle lever 20 from the latched position shown in FIG. 3 in a clockwise direction to the unlatched position shown in FIG. 5. As upper arm 24 pivots, it moves spring end 30 away from housing 12 and tightens the coils of coil spring 28 in the clockwise direction. (This stores energy in coil spring 28 for returning handle lever 20 to the latched or neutral position shown in FIGS. 2 and 3 when handle 22 is released.) As lower arm 26 pivots, it drives unlatching lever 40 clockwise to the unlatching position via drive pin 48 of child security lever 46 which engages drive shoulder 56 of unlatching lever 40. When unlatching lever 40 pivots clockwise to the unlatching position, the door latch (not shown) is unlatched by a control rod or other suitable linkage (not shown) secured to unlatching lever 40. Handle 22 is then released and handle lever 20 is returned to the latched or neutral position shown in FIGS. 2 and 3 by coil spring 28.

It should be noted that end portion 72 of push rod 71 engages bypass lever 60 pivoting bypass lever 60 counterclockwise on child security lever 46 as child security lever 46 moves clockwise with lower arm 26 during the unlatching operation. This feature allows drive pin 48 to remain in the inner end of slot 54 where drive pin 48 engages drive shoulder 56 of unlatching lever 40.

Normal Unlatching Operation with Locked Handle Mechanism

Figure 6:
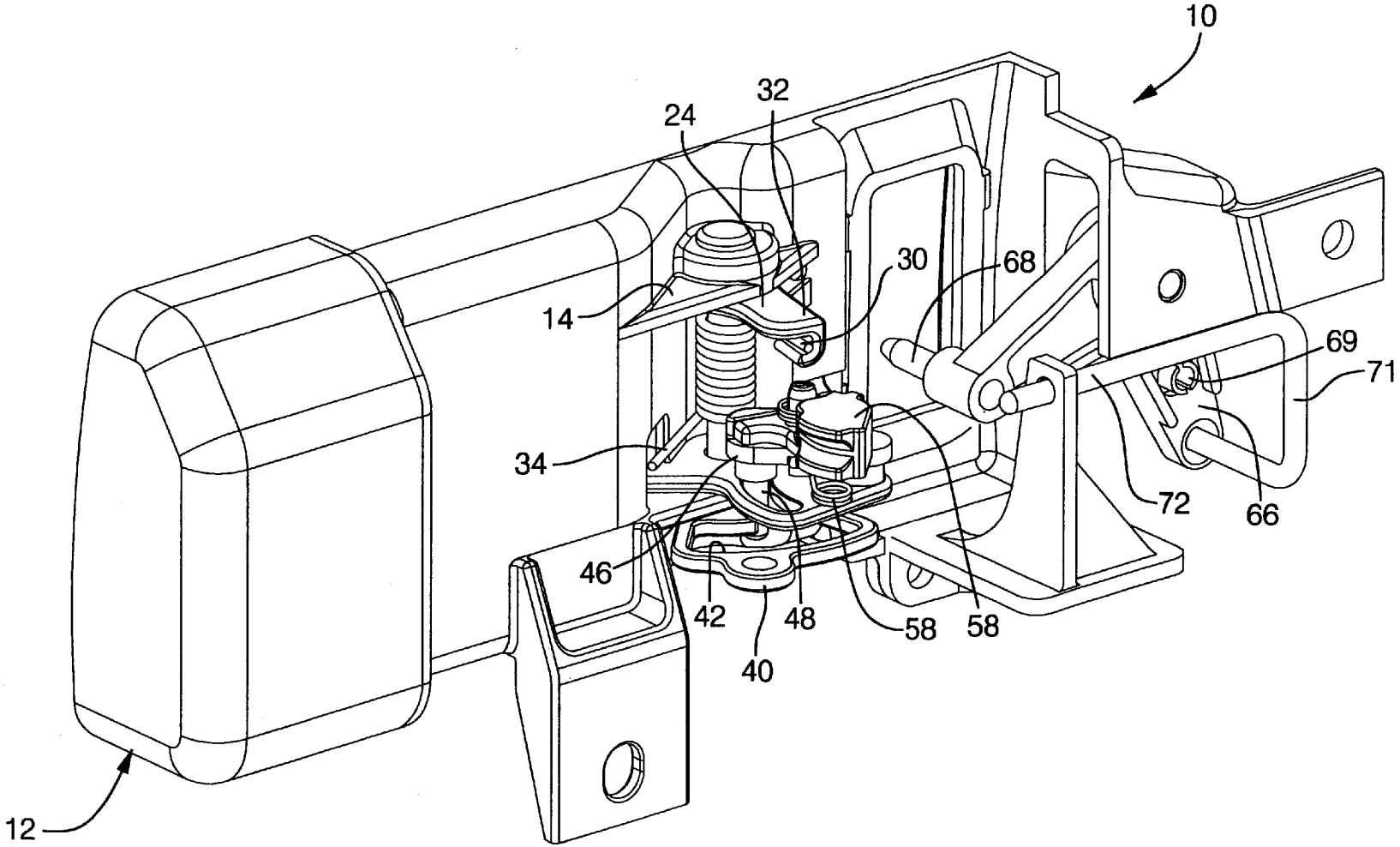
FIG. 6 is a rear perspective view showing the handle mechanism with the parts in an unlatched position when the handle mechanism is locked and the child security is disengaged.

FIG. 6 is a rear perspective view showing handle mechanism 10 with the parts in an unlatched position when the handle mechanism is locked and the child security lock is disengaged. Referring now to FIGS. 2, 3 and 6, handle mechanism 10 is locked simply by moving button handle 68 down from the unlocked position shown in FIGS. 2 and 3 to the locked position shown in FIG. 6. This rotates locking lever 66 counterclockwise from the unlocked position shown in FIG. 3 to the locked position shown in FIG. 6. As locking lever 66 is pivoted to the locked position shown in FIG. 6, a control rod or other linkage (not shown) attached to flanged hole 69 is moved to lock a conventional door latch (not shown) in a well-known manner. As locking lever 66 is pivoted to the locked position shown in FIG. 6, locking lever 66 also withdraws end portion 72 of push rod 71, translating push rod 71 to the right away from bypass lever 60, i.e., from the position shown in FIG. 3 to the position shown in FIG. 6.

The unlatching operation is still performed by pivoting handle 22 outwardly in a clockwise direction as described above and as shown in FIG. 4. However, the unlatching operation is not effective at the door latch (not shown) because the door latch has been locked by locking lever 66. It should be noted in connection with FIG. 6 that the bypass lever 60 is not effected in this case as handle lever 20 pivots clockwise from the latched position shown in FIGS. 2 and 3 to the unlatched position shown in FIG. 6 because portion 72 has been withdrawn by locking lever 66.

Operation with Child Security Lock Engaged

Figure 7:
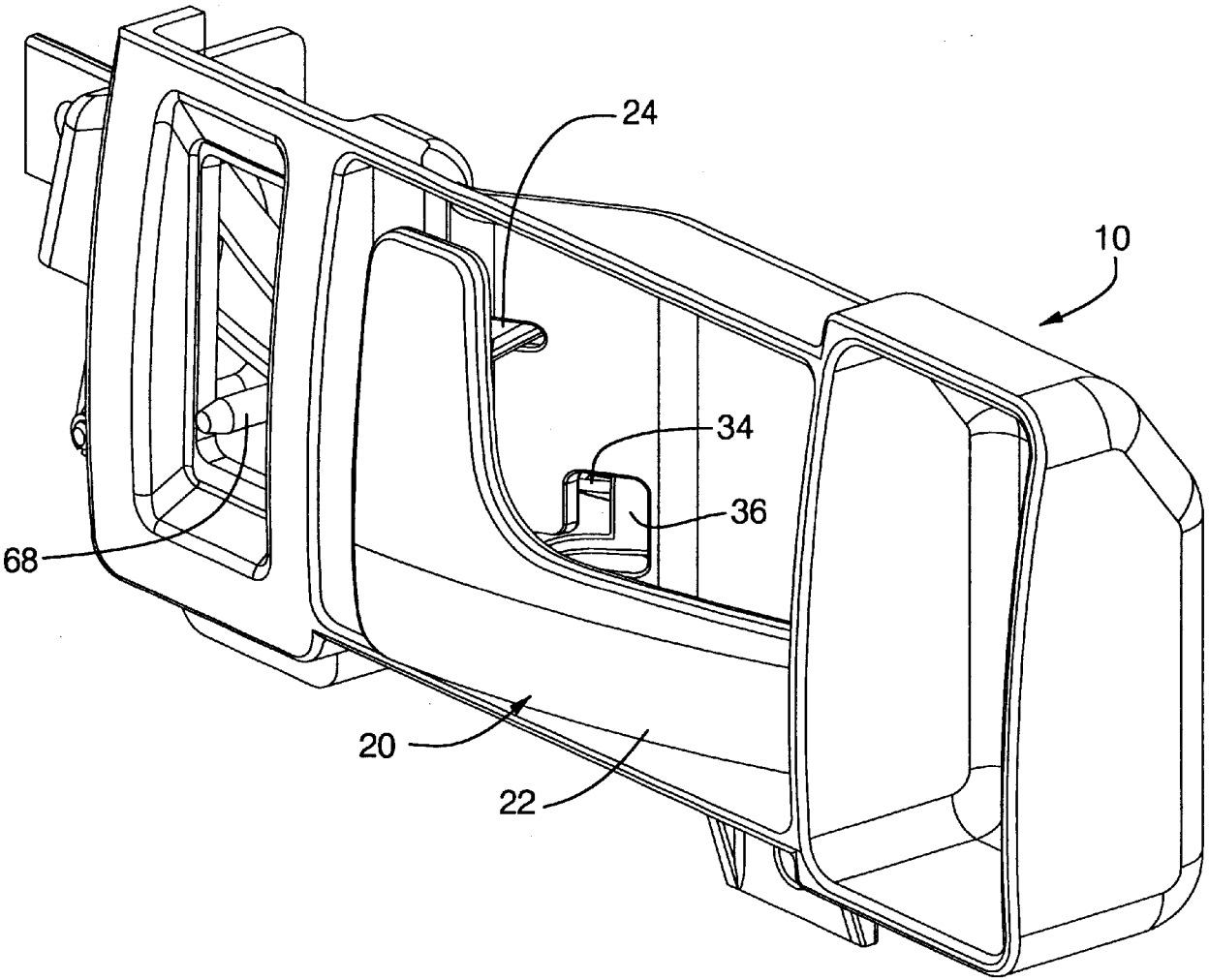
FIG. 7 is a front perspective view of the handle mechanism and FIG. 8 is a rear perspective view of the handle mechanism showing the parts in their respective positions when the child security lock is engaged with the locking lever in the locked position.

The child security lock is engaged by pushing the end of handle 22 inwardly from the flush position shown in FIG. 2 to the child security lock engage position shown in FIG. 7. This rotates handle lever 20 counterclockwise to the position shown in FIGS. 7 and 8. FIG. 7 is a front perspective view of handle mechanism 10 and FIG. 8 is a rear perspective view of handle mechanism 10 showing the parts in their respective positions when the child security lock is engaged and the locking lever 66 is in the locked position.

Figure 8:
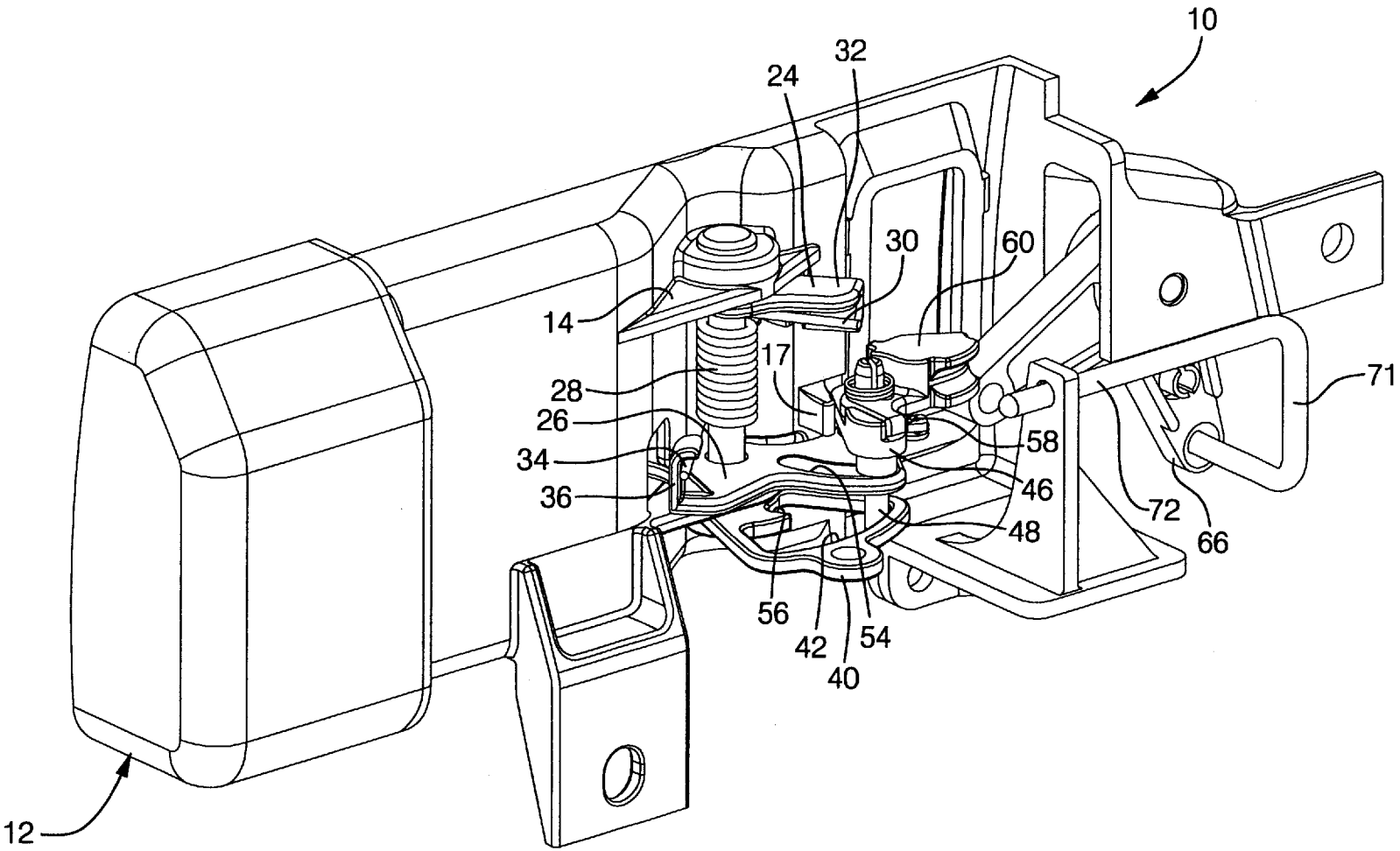

As lower arm 26 rotates counterclockwise to the child security position shown in FIG. 8, it moves spring end 34 away from housing 12 and tightens the coils of coil spring 28 in the counterclockwise direction. (This stores energy in coil spring 28 for returning handle lever 20 to the neutral or latched position shown in FIG. 2 when handle 22 is released).

As lower arm 26 rotates counterclockwise to the child security position shown in FIG. 8, cam 17 of housing 12 engages child security lever 46, pivoting child security lever 46 counterclockwise about pivot pin 50 against the action of over center spring 58. This shifts drive pin 48 to the outer end of slot 54 where drive pin 48 is now biased by the over center spring 58. Drive pin 48 also shifts outwardly out of engagement with drive shoulder 56 and into the wider portion of slot 42 in unlatching lever 40.

After the child security lock is engaged, handle 22 is released and the handle lever 20 is pivoted clockwise and returned to the neutral position where spring end 34 engages housing 12 (not shown). (The neutral position of arms 24 and 26 are about 10° clockwise from the position shown in FIG. 8).

The unlatching operation is now ineffective at the handle mechanism 10. When handle lever 20 is pivoted clockwise from the neutral position to the unlatched position shown in FIGS. 4 and 5, the drive pin 48 simply moves in slot 42 without imparting any motion to unlatching lever 40. Hence the door latch (not shown) that is connected to unlatching lever 40 by a control rod or other linkage (not shown) is not unlatched.

Figure 9:
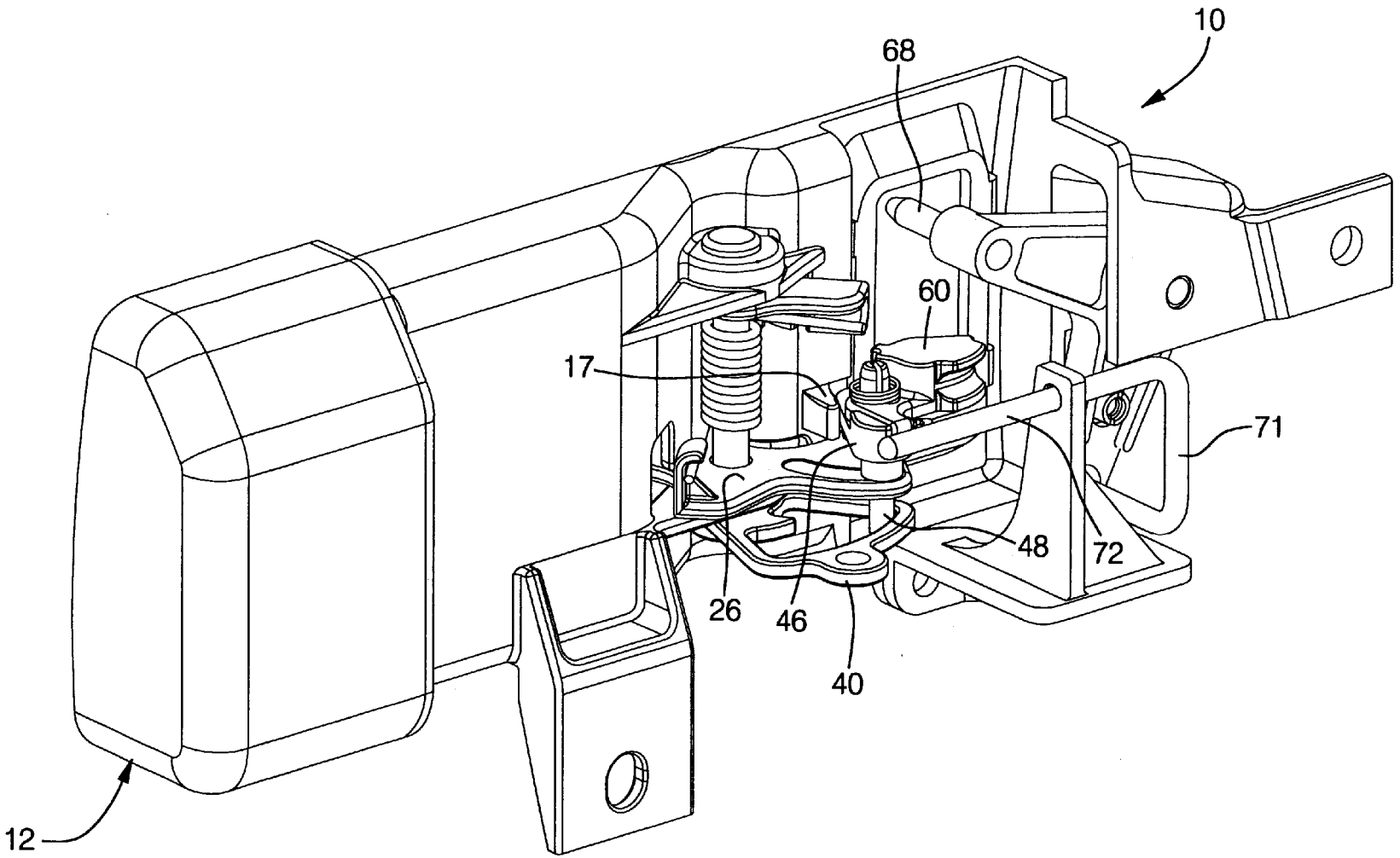
FIG. 9 is a rear perspective view of the handle mechanism showing the parts in their respective positions when the child security lock is engaged with the locking lever in the unlocked position.

The child security lock can be engaged after an automotive door is closed, latched and locked as demonstrated above. However, the child security lock can also be engaged when the locking lever 66 is in the unlocked position shown in FIGS. 2 and 3 before or after the vehicle door is closed. The child security lock is still engaged by pushing the end of handle 22 inwardly to the child security lock position shown in FIG. 7 and the parts move to the same position except that the locking lever 66 and push rod are in the unlocked position as shown in FIG. 9. Thus when handle 22 is released, bypass lever 60 engages the end portion 72 of rod 71 tangentially as child security lever 50 pivots clockwise about 100 with lower arm 26 to the latch position (not shown). Drive pin 48 is still shifted to and biased against the outer end of slot 54 by over center spring 58 and also shifted outwardly out of engagement with drive shoulder 56 and into the wider portion of slot 42 in unlatching lever 40 so that the unlatching operation is not effective after the child security lock is engaged.

Disengagement of the Child Security Lock

The child security lock is disengaged by simultaneous operation of handle lever 20 and locking lever 66 in a two-handed operation. Basically, handle lever 20 is moved to and held in the unlatching position with one hand while the locking lever 66 is cycled by the other hand.

The child security lock can be disengaged when the locking lever 66 is in the locked position shown in FIGS. 7 and 8 or in the unlocked position shown in FIG. 9 and after the handle lever returns to the latched or neutral position (not shown).

Figure 10:
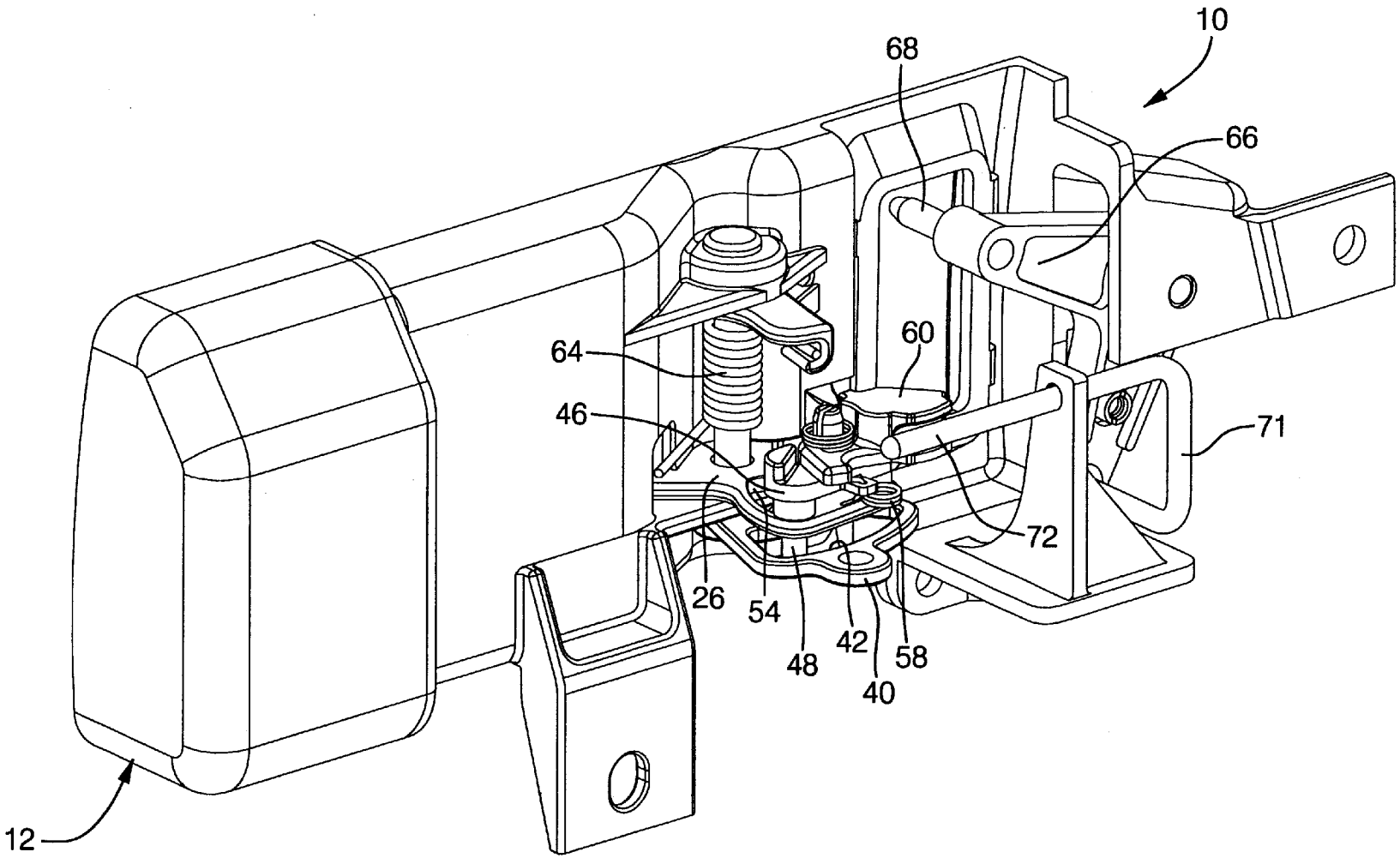
FIG. 10 is a rear perspective view of the handle mechanism showing the parts in their respective positions when the handle lever is pivoted to the unlatch position.

Referring first to FIGS. 10 through 14, the child security lock is disengaged when locking lever 66 is in the unlocked position as follows. First handle lever 20 is pivoted clockwise from the latched neutral position (not shown) to the unlatch position shown in FIG. 10. As lower arm 26 pivots clockwise, drive pin 48 is held against the outer end of slot 54 by over center spring 58 and moves to the opposite outer end of the wide outer part of slot 42 in unlatching lever 40 as shown in FIG. 10. Child security lever 46 thus pivots with lower arm 26 remaining stationary with respect to lower arm 26. However, bypass lever 60 is held by the end portion 72 of rod 71 so that bypass lever 60 pivots counterclockwise on child security lever 46 away from stop 64 as child security lever 46 pivots clockwise to the position shown in FIG. 10.

Figure 11:
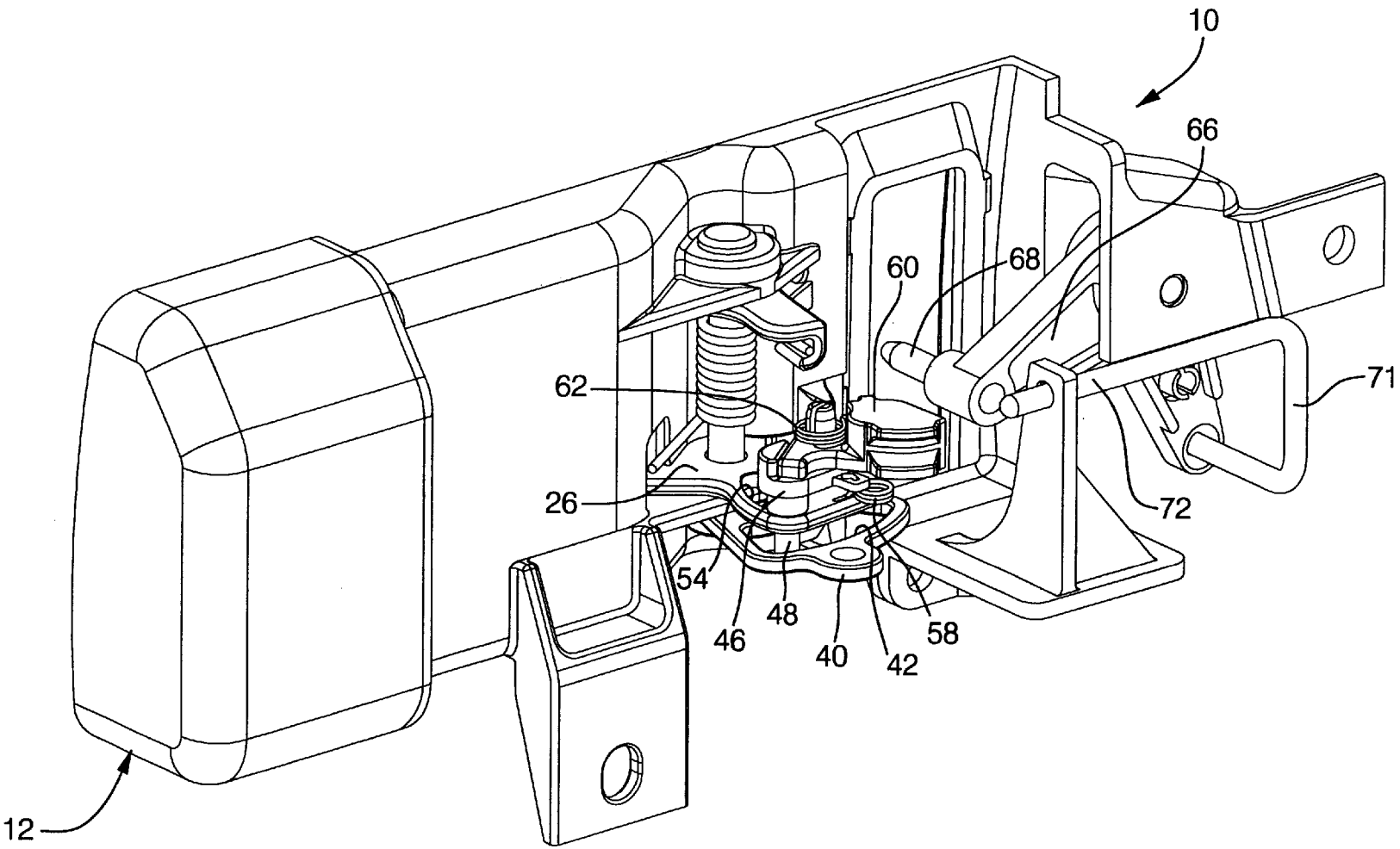
FIG. 11 is a rear perspective view of the handle mechanism showing the parts in their respective positions when the locking lever is pivoted to the locked position while the handle lever is held in the unlatch position.
Figure 12:
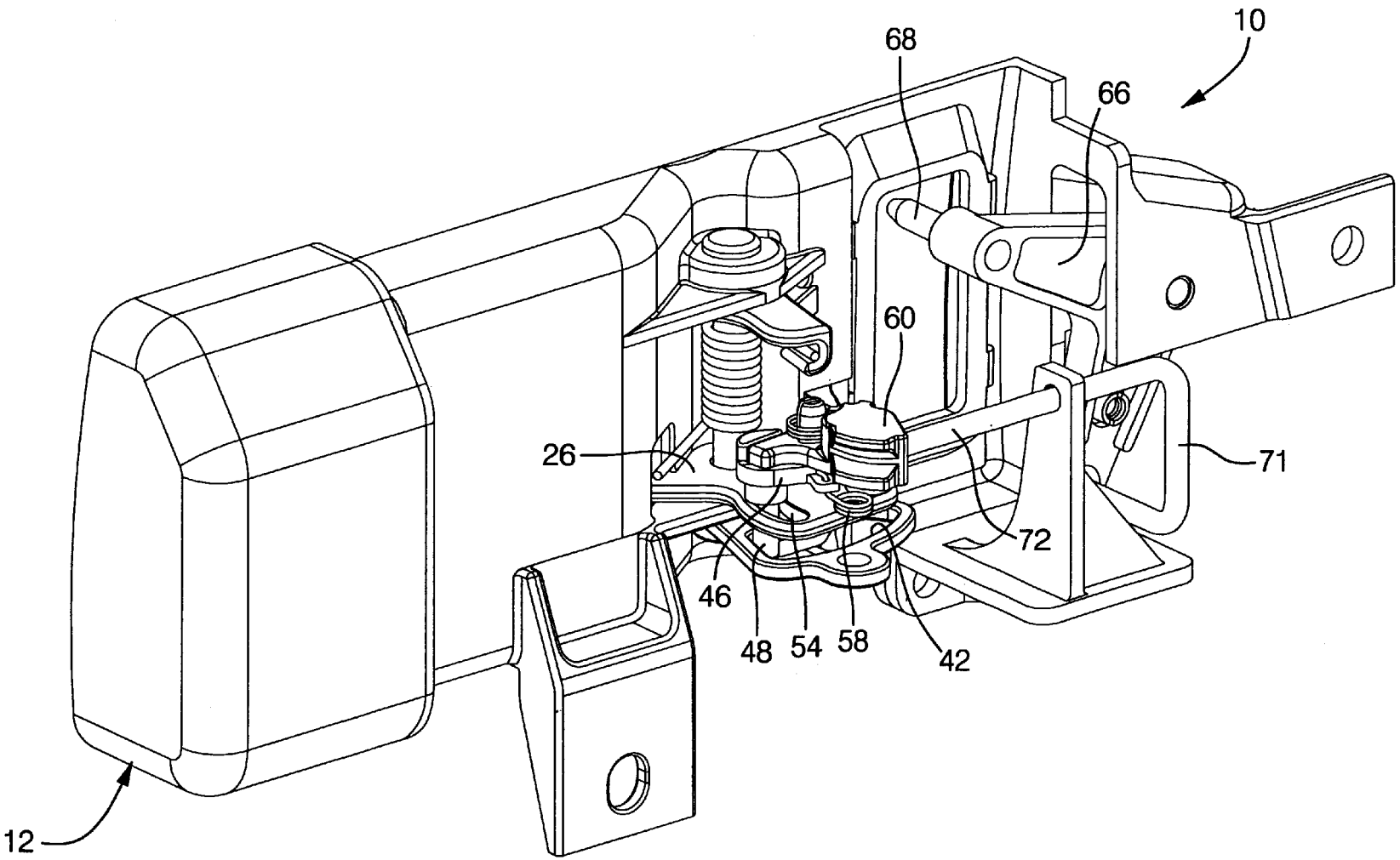
FIG. 12 is a rear perspective view of the handle mechanism showing the parts in their respective positions when the locking lever is pivoted back to the unlocked position while handle lever is held in the unlatch position.

The handle lever 20 is held in the unlatching position shown in FIG. 10 while the locking lever 66 is pivoted clockwise to the locked position shown in FIG. 11 by pushing button handle 68 down. This withdraws rod 71, i.e., moves rod 71 to the right as viewed in FIG. 10. The withdrawing rod 71 releases bypass lever 60 which then pivots clockwise under the action of spring 62 into driving engagement with child security lever 46 and into the travel path of the end portion 72 of rod 71 as shown in FIG. 11.

Locking lever 66 is then pivoted back to the unlocked position by pushing button handle 68 up while handle lever 20 is kept in the unlatching position. This projects rod end portion 72 forward, i.e., translates rod end portion 72 to the left from the position shown in FIG. 11 to the position shown in FIG. 12. Rod end portion 72 engages bypass lever 60 driving bypass lever 60 to the left, which pivots child security lever 46 clockwise about pivot 50 which moves drive pin 48 from the outer end of slot 54 toward the inner end of slot 54 enough so that drive pin 48 is biased toward the inner end of slot 34 by over center spring 58. Drive pin 48 is also moved radially inwardly toward the narrow inner portion of slot 42 and the drive shoulder 56 of unlatching lever 40.

Figure 13:
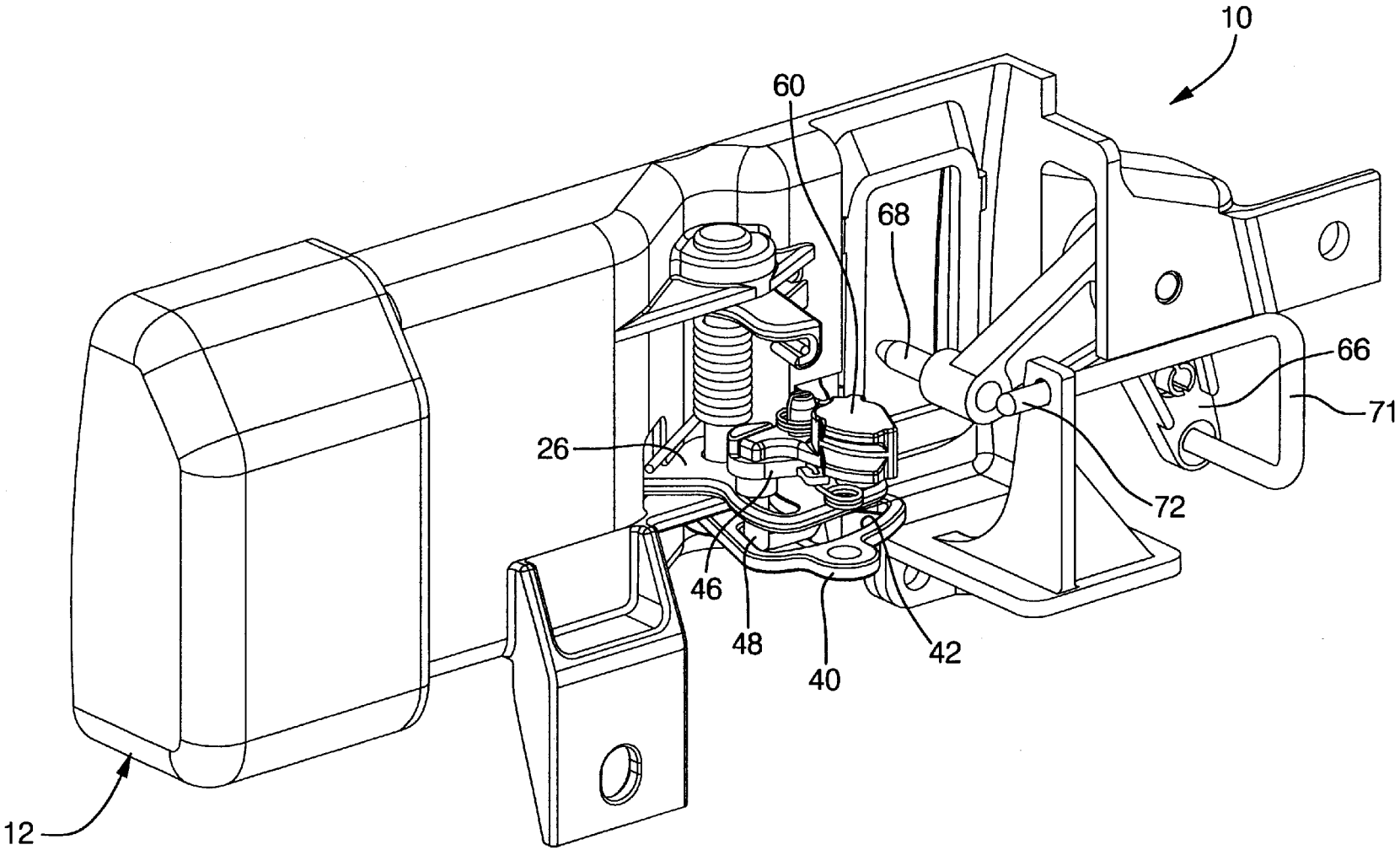
FIG. 13 is a rear perspective view of the handle mechanism showing the parts in their respective positions when the locking lever is pivoted back to the lock position while handle lever is held in the unlatch position.

Locking lever 66 is then pivoted back to the locked position by pushing button handle 68 down while handle lever 20 is still held in the unlatching position as shown in FIG. 13. This withdraws rod 71 to the right as viewed in FIG. 13, that is, away from bypass lever 60.

Figure 14:
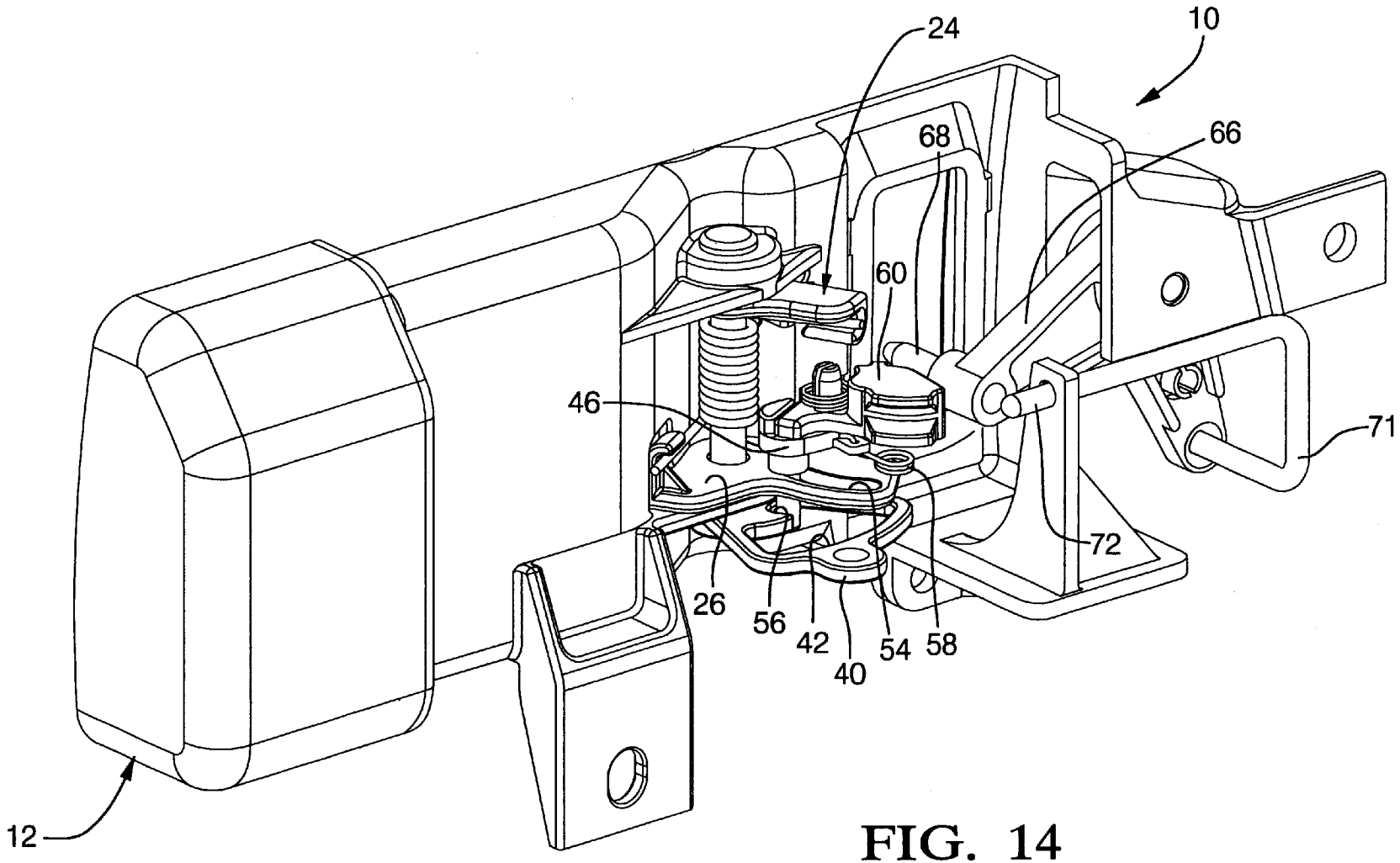
FIG. 14 is a rear perspective view of the handle mechanism showing the parts in their respective positions when the handle lever is released and returns to the neutral or latched position.

After locking lever 66 is cycled from unlock to lock to unlock to lock, handle lever 20 is released so that coil spring 28 returns handle lever 20 to the neutral or latched position shown in FIG. 14. As lower arm 26 of handle lever pivots counterclockwise from the unlatched position shown in FIG. 13 to the latched position shown in FIG. 14, drive pin 48 is biased inwardly against the inner end of slot 54 and into engagement with drive shoulder 56 in the narrow inner end of slot 42 by over center spring 58. The handle mechanism 10 is now latched and locked with the child security lock disengaged. The door latch (not shown) operated by the handle mechanism 10 can now be unlocked by pivoting the button handle 68 up to the unlocked position shown in FIGS. 2 and 3 and then unlatched by pulling the end of handle 22 outwardly as shown in FIGS. 4 and 5.

The child security lock can also be disengaged when the locking lever 66 is in the locked position shown in FIGS. 7 and 8 and the handle lever 20 returns to the neutral or latched position (not shown).

Disengagement of the child security lock is still a two-handed operation. However, the first cycling step of the locking lever 66 is eliminated. The handle lever 20 is still pivoted outwardly and held in the unlatching position. However, the locking lever 66 need not be moved to the locked position shown in FIG. 11 because it is already in the locked position. Hence, the child security lock is disengaged by moving the handle lever 20 to the unlatched position shown in FIG. 11 and cycling the locking lever from the locked position of FIG. 11 to the unlocked position of FIG. 12 back to the locked position of FIG. 13 while the handle lever 20 is held in the unlatched position and then releasing the handle lever 20 so that it returns to the neutral or latched position shown in FIG. 14. As indicated above, the handle mechanism 10 is now latched and locked with the child security lock disengaged. The door latch (not shown) operated by the handle mechanism 10 can now be unlocked by pivoting the button handle 68 up to the unlocked position shown in FIGS. 2 and 3 and then unlatched by pulling the end of handle 22 outwardly as shown in FIGS. 4 and 5.

Obviously, many modifications and variations of the present invention in light of the above teachings may be made. It is, therefore, to be understood that, within the scope of the appended claims, the invention may be practiced otherwise than as specifically described.

What is claimed is:

1. A handle mechanism for operating a vehicle door latch having a latching mechanism and a locking mechanism comprising:

a support, an unlatching lever that pivots on the support and that has a latched position and a unlatched position, the unlatching lever pivoting back and forth between the latched position and the unlatched position for operating the latching mechanism of a vehicle door latch, a handle lever that pivots on the support and that has a latched position, an unlatched position and a child security engage position with respect to the support, the handle lever pivoting back and forth between the latched position and the unlatched position, the handle lever being operatively connected to the unlatching lever for moving the unlatching lever back and forth between the latched position and the unlatched position of the unlatching lever as the handle lever moves back and forth between the latched position and the unlatched position of the handle lever, first means for decoupling the handle lever from the unlatching lever so that the handle lever cannot pivot the unlatching lever to the unlatched position of the unlatching lever to unlatch the vehicle door latch including a child security lock that pivots on the handle lever and that has a disengaged position and an engaged position with respect to the handle lever, the child security lock pivoting back and forth between the disengaged and engaged position and decoupling the handle lever from the unlatching lever in the engaged position so that the handle lever cannot pivot the unlatching lever to the unlatched position of the unlatching lever to unlatch the vehicle door latch, and second means for coupling the handle lever to the unlatching lever when decoupled including a button handle that pivots on the support and that has a locked position and an unlocked position with respect to the support, the button handle pivoting back and forth between the locked and unlocked positions for operating the locking mechanism of the vehicle door latch, the child security lock being pivoted to the engaged position by pivoting the handle lever to the child security engage position and pivoted to the disengaged position by pivoting the handle lever to the unlatched position and cycling the button handle between its locked and unlocked positions while the handle lever is held in the unlatched position.

2. The handle mechanism as defined in claim 1 wherein the child security lock is disengaged when the button handle is cycled from the locked position to the unlocked position back to the locked position while the handle lever is held in the unlatched position.

3. The handle mechanism as defined in claim 1 wherein the child security lock is disengaged when the button handle is cycled from the unlocked position to the locked position to the unlocked position back to the locked position while the handle lever is held in the unlatched position.

4. A handle mechanism for operating a vehicle door latch having a latching mechanism and a locking mechanism comprising:

a support having a pivot pin, an unlatching lever that pivots on the pivot pin and that has a latched position and a unlatched position, the unlatching lever pivoting back and forth between the latched position and the unlatched position for operating the latching mechanism of a vehicle door latch, a handle lever that pivots on the pivot pin and that has a latched position, an unlatched position and a child security engage position with respect to the support, the handle lever pivoting back and forth between the latched position and the unlatched position, first means for decoupling the handle lever from the unlatching lever so that the handle lever cannot pivot the unlatching lever to the unlatched position of the unlatching lever to unlatch the vehicle door latch including a child security lock that pivots on the handle lever and that has a disengaged position and an engaged position with respect to the handle lever, the child security lock pivoting back and forth between the disengaged and engaged position, the handle lever being operatively connected to the unlatching lever by the child security lock for moving the unlatching lever back and forth between the latched position and the unlatched position of the unlatching lever as the handle lever moves back and forth between the latched position and the unlatched position of the handle lever when the child security lock is in the engaged position, the handle lever being disconnected from the unlatching lever so that the handle lever cannot pivot the unlatching lever to the unlatched position of the unlatching lever to unlatch the vehicle door latch when the child security lock is in the engaged position, and second means for coupling the handle lever to the unlatching lever when decoupled including a button handle that pivots on the support and that has a locked position and an unlocked position with respect to the support, the button handle pivoting back and forth between the locked and unlocked positions for operating the locking mechanism of the vehicle door latch and decoupling the handle lever from the unlatching lever in the engaged position so that the handle lever cannot pivot the unlatching lever to the unlatched position of the unlatching lever to unlatch the vehicle door latch, a push rod that moves on the support between a retracted position and an extended position, the push rod being moved between the retracted position and the extended position by the button handle as the button handle pivots between the locked position and the unlocked position, and the child security lock being pivoted to the engaged position by pivoting the handle lever to the child security engage position and pivoted to the disengaged position by pivoting the handle lever to the unlatched position and cycling the button handle between its locked and unlocked positions while the handle lever is held in the unlatched position, so that the push rod is moved to the extended position by the button handle to pivot the child security lock to the disengaged position.

5. The handle mechanism as defined in claim 4 further including a coil spring that surrounds the pivot pin loosely, the coil spring having two tangenial ends that engage both the support and the handle lever to bias the handle lever in the latched position of the handle lever.

6. The handle mechanism as defined in claim 4 wherein the child security lock has a drive pin that extends through a slot of the child security lock and engages a drive shoulder of the unlatching lever when the handle lever is operatively connected to the unlatching lever.

7. A handle mechanism for operating a vehicle door latch having a latching mechanism and a locking mechanism comprising:

a support having a pivot pin, an unlatching lever that pivots on the pivot pin and that has a latched position and a unlatched position, the unlatching lever pivoting back and forth between the latched position and the unlatched position for operating the latching mechanism of a vehicle door latch, a handle lever that pivots on the pivot pin and that has a latched position, an unlatched position and a child security engage position with respect to the support, the handle lever pivoting back and forth between the latched position and the unlatched position, first means for decoupling the handle lever from the unlatching lever so that the handle lever cannot pivot the unlatching lever to the unlatched position of the unlatching lever to unlatch the vehicle door latch including a child security lock that pivots on the handle lever and that has a disengaged position and an engaged position with respect to the handle lever, the child security lock pivoting back and forth between the disengaged and engaged position, the handle lever being operatively connected to the unlatching lever by the child security lock for moving the unlatching lever back and forth between the latched position and the unlatched position of the unlatching lever as the handle lever moves back and forth between the latched position and the unlatched position of the handle lever when the child security lock is in the engaged position, the handle lever being disconnected from the unlatching lever so that the handle lever cannot pivot the unlatching lever to the unlatched position of the unlatching lever to unlatch the vehicle door latch when the child security lock is in the engaged position, and second means for coupling the handle lever to the unlatching lever when decoupled including a button handle that pivots on the support and that has a locked position and an unlocked position with respect to the support, the button handle pivoting back and forth between the locked and unlocked positions for operating the locking mechanism of the vehicle door latch and disabling the handle mechanism in the engaged position so that the handle lever cannot pivot the unlatching lever to the unlatched position of the unlatching lever to unlatch the vehicle door latch, a push rod that moves on the support between a retracted position and an extended position, the push rod being moved between the retracted position and the extended position by the button handle as the button handle pivots between the locked position and the unlocked position, the child security lock being pivoted to the engaged position by pivoting the handle lever to the child security engage position and pivoted to the disengaged position by pivoting the handle lever to the unlatched position and cycling the button handle between its locked and unlocked positions while the handle lever is held in the unlatched position, so that the push rod is moved to the extended position by the button handle to pivot the child security lock to the disengaged position, the drive pin engaging one end of the slot when the child security lock is in the engaged position and an opposite end of the slot when the child security lock is in the disengaged position, and the handle mechanism further including an over center spring that is operatively connected to the handle lever and the child security lever to bias the drive pin against the one end or the opposite end of the slot.

8. A handle mechanism for operating a vehicle door latch having a latching mechanism and a locking mechanism comprising:

a support having a pivot pin, an unlatching lever that pivots on the pivot pin and that has a latched position and a unlatched position, the unlocking lever pivoting back and forth between the latched position and the unlatched position for operating the latching mechanism of a vehicle door latch, a handle lever that pivots on the pivot pin and that has a latched position, an unlatched position and a child security engage position with respect to the support, the handle lever pivoting back and forth between first means for decoupling the handle lever from the unlatching lever so that the handle lever cannot pivot the unlatching lever to the unlatched position of the unlatching lever to unlatch the vehicle door latch including a child security lock that pivots on the handle lever and that has a disengaged position and an engaged position with respect to the handle lever, the child security lock pivoting back and forth between the disengaged and engaged position, the handle lever being operatively connected to the unlatching lever by the child security lock for moving the unlatching lever back and forth between the latched position and the unlatched position of the unlatching lever as the handle lever moves back and forth between the latched position and the unlatched position of the handle lever when the child security lock is in the engaged position, the handle lever being disconnected from the unlatching lever so that the handle lever cannot pivot the unlatching lever to the unlatched position of the unlatching lever to unlatch the vehicle door latch when the child security lock is in the engaged position, and second means for coupling the handle lever to the unlatching lever when decoupled including a button handle that pivots on the support and that has a locked position and an unlocked position with respect to the support, the button handle pivoting back and forth between the locked and unlocked positions for operating the locking mechanism of the vehicle door latch and disabling the handle mechanism in the engaged position so that the handle lever cannot pivot the unlatching lever to the unlatched position of the unlatching lever to unlatch the vehicle door latch, a push rod that moves on the support between a retracted position and an extended position, the push rod being moved between the retracted position and the extended position by the button handle as the button handle pivots between the locked position and the unlocked position, and the child security lock being pivoted to the engaged position by pivoting the handle lever to the child security engage position and pivoted to the disengaged position by pivoting the handle lever to the unlatched position and cycling the button handle between its locked and unlocked positions while the handle lever is held in the unlatched position, so that the push rod is moved to the extended position by the button handle to pivot the child security lock to the disengaged position, a child security lever and a by-pass lever that pivots on the child security lever, the by-pass lever being driven by the push rod when the child security lock is pivoted to the disengaged position.

9. The handle mechanism as defined in claim 1 further including a push rod that moves on the support between a retracted position and an extended position, the push rod being moved to the extended position by the button handle to pivot the child security lock to the disengaged position.

* * * * *